US006527017B2

(12) United States Patent
Shirakawa et al.

(10) Patent No.: US 6,527,017 B2
(45) Date of Patent: Mar. 4, 2003

(54) BINDING APPARATUS

(75) Inventors: Yuji Shirakawa, Tokyo (JP); Shigenobu Nirei, Tokyo (JP)

(73) Assignee: Nirei Industry Co., Ltd. (JP)

( * ) Notice: Subject to any disclaimer, the term of this patent is extended or adjusted under 35 U.S.C. 154(b) by 0 days.

(21) Appl. No.: 09/785,093

(22) Filed: Feb. 16, 2001

(65) Prior Publication Data

US 2001/0039976 A1 Nov. 15, 2001

(30) Foreign Application Priority Data

Feb. 24, 2000 (JP) ..... 2000-048209

(51) Int. Cl.[7] ..... B21F 9/02
(52) U.S. Cl. ..... 140/123.6; 29/267
(58) Field of Search ..... 29/267, 270; 140/93 R, 140/93.2, 123.6; 254/216

(56) References Cited

U.S. PATENT DOCUMENTS

| | | | | |
|---|---|---|---|---|
| 2,569,623 A | * | 10/1951 | Wognum | 140/93 R |
| 3,179,128 A | * | 4/1965 | Price | 140/123.6 |
| 3,645,302 A | * | 2/1972 | Caveney et al. | 140/123.6 |
| 5,351,611 A | * | 10/1994 | Schafer et al. | 140/123.6 |

FOREIGN PATENT DOCUMENTS

FR 2 223 141 10/1974

OTHER PUBLICATIONS

Partial Translation of Japanese Utility Model Publication No. 3933/1992 (4–3933).

* cited by examiner

*Primary Examiner*—Lowell A. Larson
(74) *Attorney, Agent, or Firm*—Lerner, David, Littenberg, Krumholz & Mentlik, LLP

(57) ABSTRACT

A binding apparatus capable of facilitating reliable tightening of a binding belt without directly touching the binding belt. The apparatus includes a body provided therein with a belt passage and a fastener passage. The belt passage functions to guide therethrough a continuous binding belt formed on one side surface thereof with asperities in a rack-like manner. Fasteners guided in the fastener passage are each provided with holding pawls engageable with the asperities of the binding belt. The belt passage is formed with an opening through which the binding belt is exposed. A tightening lever is pivotally mounted on the body and includes a gear portion releasably engaged with the asperities of the binding belt exposed from the opening of the belt passage. A cutter cuts the binding belt while a foremost one of the fasteners holds a distal end of a portion of the binding belt wound around an article on one of the holding pawls of the fastener to bind the article with the portion of the binding belt.

23 Claims, 11 Drawing Sheets

BINDING APPARATUS

BACKGROUND OF THE INVENTION

This invention relates to a binding apparatus, and more specifically to a binding apparatus which is constructed so as to wind a continuous binding belt around an article or articles to be bound, fasten the binding belt by means of a fastener to bind the article(s) and then separate an unnecessary portion of the binding belt from the article(s) by cutting.

A conventional binding apparatus of this type is disclosed in each of Japanese Utility Model Publications Nos. 3933/1992, 3934/1992, 3935/1992 and 3936/1992. The binding apparatus disclosed includes a body which is formed therein with a belt passage through which a continuous binding belt is fed and a fastener passage in which a plurality of fasteners are received while being kept aligned with each other. In the binding apparatus thus constructed, a foremost fastener of the plurality of fasteners arranged in the fastener passage is fed to a distal end of the belt passage and a binding belt is wound around an article or articles to be bound while being extended through the fastener. Then, the binding belt is held at a distal end thereof on a holding pawl of the fastener to bind the article(s), followed by separation of a portion of the binding belt which is wound around the article from the binding belt by a cutter. Thus, the conventional binding apparatus eliminates waste of the binding belt because only a binding belt in a length required for binding of an article or articles is used in each binding operation.

However, in the conventional binding apparatus, firm tightening of the binding belt is required in order to securely binding the article(s). For this purpose, it is required to fully tighten the binding belt drawn out of a body of the apparatus by a hand. In this regard, the binding belt is reduced in width and formed on one side thereof with teeth in a row in a rack-like manner. Thus, an operator fails to satisfactorily tighten the binding belt while firmly grasping it, because a binding operation in such a manner causes much pain to a hand of the operator. In order to avoid the problem, it is required to cover a portion of the binding belt to be grasped with a towel or the like. Thus, tightening of the binding belt is highly troublesome.

SUMMARY OF THE INVENTION

The present invention has been made in view of the foregoing disadvantage of the prior art.

Accordingly, it is an object of the present invention to provide a binding apparatus which is capable of readily and positively tightening a binding belt without directly touching the binding belt.

In accordance with the present invention, a binding apparatus is provided. The binding apparatus includes a body provided therein with a belt passage and a fastener passage. The belt passage guides therethrough a continuous binding belt formed on one side surface thereof with asperities in a rack-like manner and the fastener passage guides a plurality of fasteners therethrough while keeping the fasteners arranged in a row. The fasteners are each provided with holding pawls engageable with the asperities of the binding belt. The binding apparatus also includes a cutter for cutting the binding belt in a state where a foremost fastener of the fasteners located at a distal end of the fastener passage is fed to a distal end of the belt passage and the binding belt is held by the foremost fastener on one of the holding pawls at a distal end of a portion of the binding belt, which portion is wound around an article while being extended through the foremost fastener, to bind the article with the portion of the binding belt. The belt passage is formed with an opening through which the binding belt is exposed. The binding apparatus further includes a tightening mechanism movably mounted on the body. The tightening mechanism includes a gear portion constructed so as to be releasably connected with the asperities of the binding belt exposed from the opening of the belt passage.

In a preferred embodiment of the present invention, the tightening mechanism includes a tightening lever which is formed thereon with the gear portion so as to be engageable with the asperities of the binding belt and pivotably arranged.

In a preferred embodiment of the present invention, the tightening lever is arranged so as to access the belt passage and to be moved away from the belt passage.

In a preferred embodiment of the present invention, the gear portion of the tightening lever comprises a plurality of teeth arranged on a distal end of the tightening lever in an arcuate manner.

In a preferred embodiment of the present invention, a spring is arranged for elastically urging the tightening lever so that the tightening lever is spaced from the belt passage.

When the tightening mechanism is constituted by a tightening lever, the tightening lever may be formed thereon with the gear portion so as to be engageable with the asperities of the binding belt and may be arranged so as to be movable substantially in parallel to the binding belt.

Alternatively, the tightening mechanism may include a tightening gear rotatably mounted on the body. The tightening gear is engaged with the asperities of the binding belt exposed from the opening of the belt passage and rotated to tighten the binding belt in association with the gear portion. In addition, the tightening mechanism may include a tightening lever which is formed thereon with the gear portion and pivotally arranged, wherein the gear portion is constructed so as to be releasably engaged with the tightening gear.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a binding apparatus according to the present invention will be described with reference to the accompanying drawings.

Figure 1:
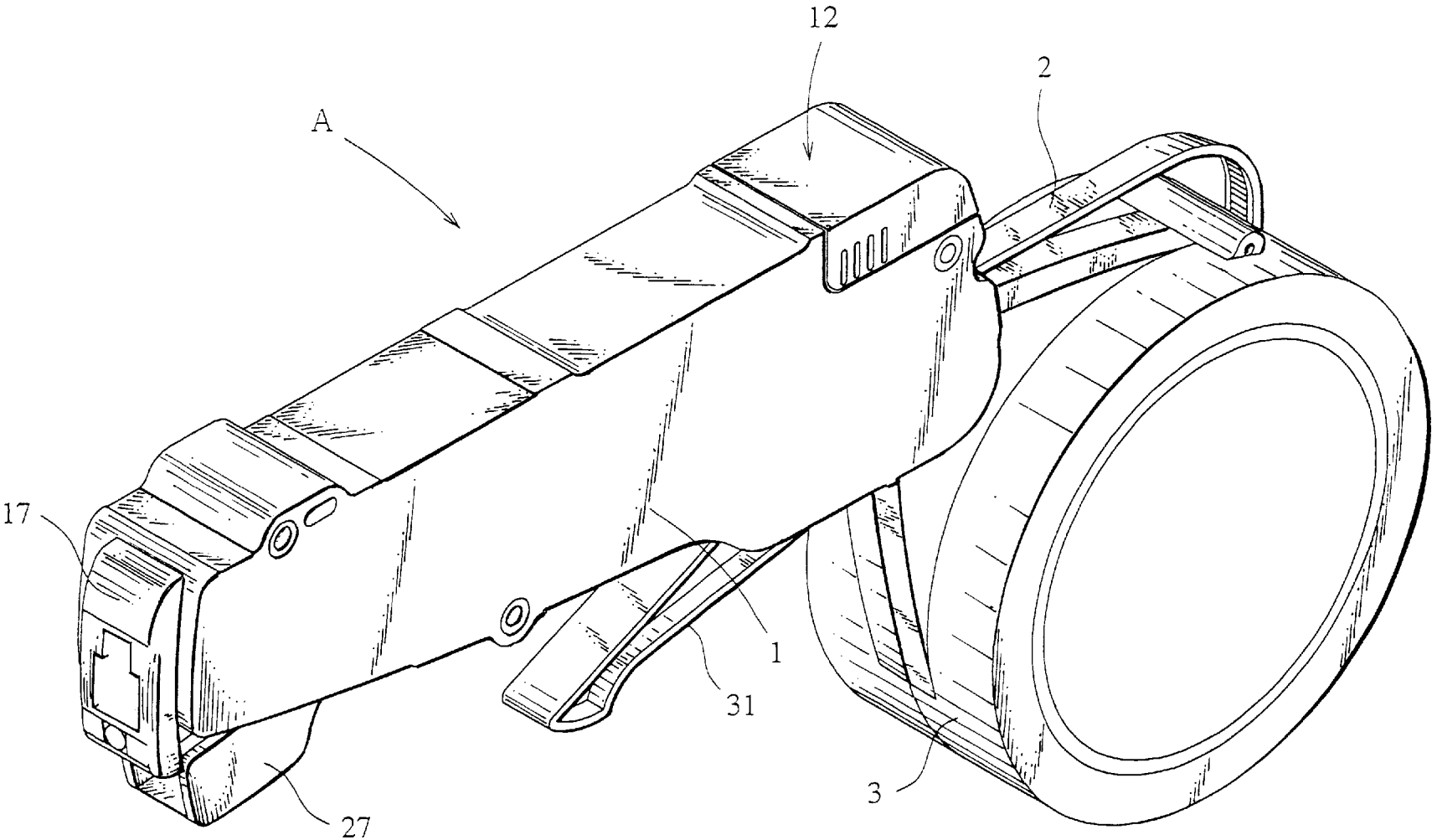
FIG. 1 is a perspective view showing an embodiment of a binding apparatus according to the present invention.
Figure 2:
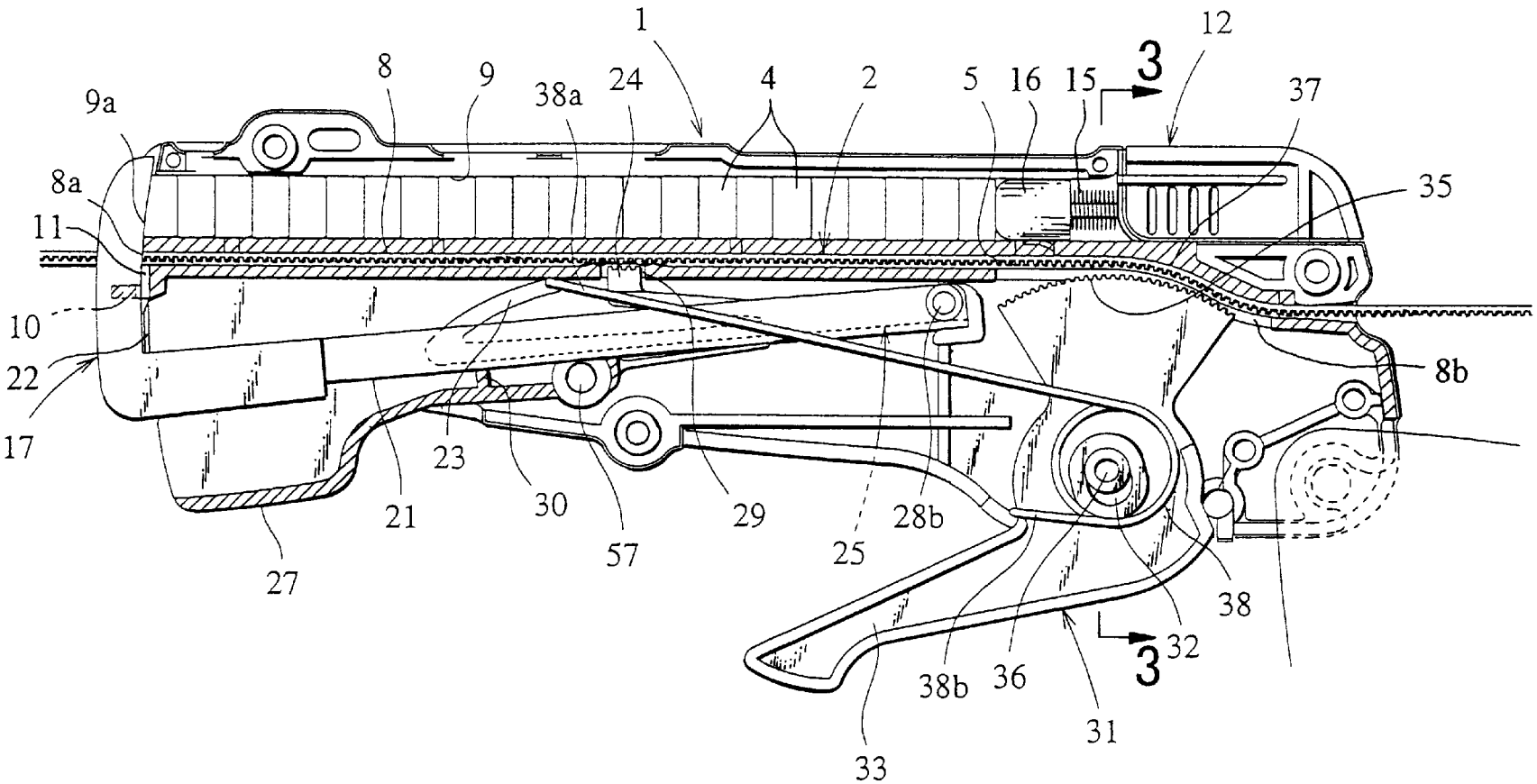
FIG. 2 is a vertical sectional view of the binding apparatus shown in FIG. 1.
Figure 5A:
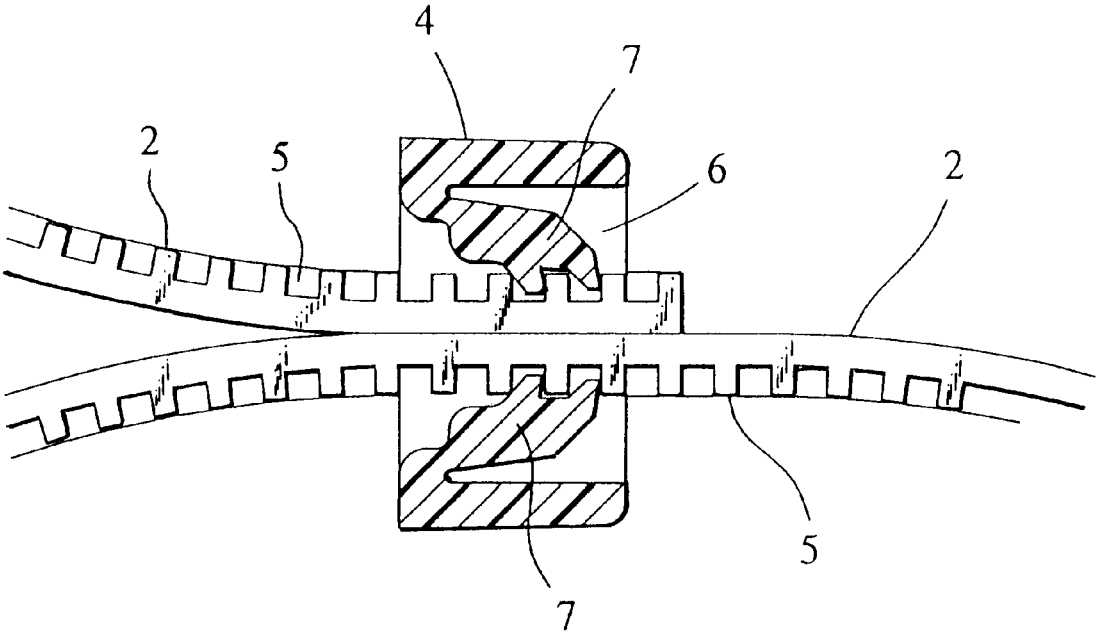
FIG. 5A is a sectional view showing a fastener and a binding belt incorporated in the binding apparatus shown in FIG. 1.
Figure 5B:
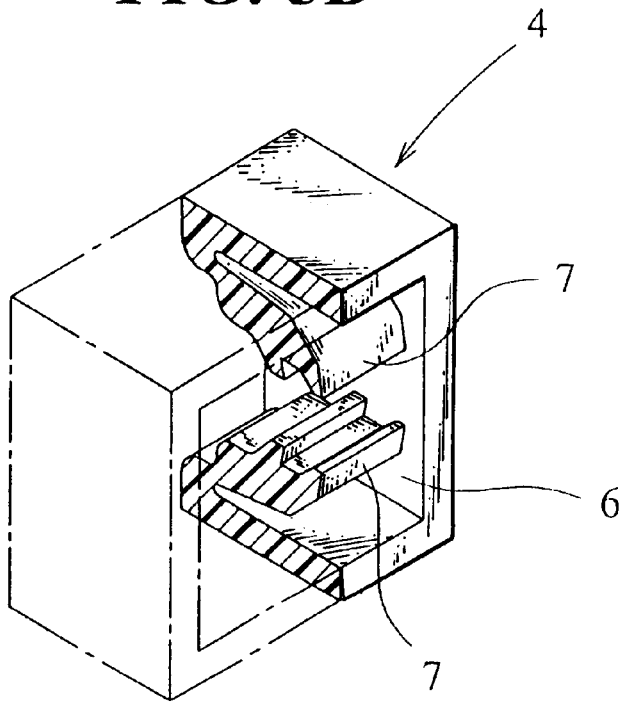
FIG. 5B is a partly cutaway perspective view of the fastener shown in FIG. 5A.

Referring first to FIGS. 1 and 2, an embodiment of a binding apparatus according to the present invention is illustrated. A binding apparatus of the illustrated embodiment generally designated by reference character. A generally includes a body 1 and a belt casing 3 having a continuous binding belt 2 drawably received therein while being wound and is adapted to bind an article or articles to be bound due to cooperation between the binding belt 2 and a fastener 4. The binding belt 2 is made of a flexible synthetic resin material and formed to have a continuous elongated configuration. The binding belt 2, as shown in FIG. 5A, is formed on a central portion of one of both side surfaces thereof defined in a longitudinal direction thereof to with ruggedness or asperities 5 in a rack-like manner. The fastener 4 is made of a synthetic resin material and generally formed to have a rectangular parallelepiped configuration as shown in FIGS. 5A and 5B. More specifically, the fastener 4 is formed with an insertion hole 6 through which the binding belt 2 is inserted. Also, the fastener 4 is provided on inner surfaces thereof opposite to each other with holding pawls 7 each adapted to be engaged with the asperities 5 of the binding belt 2.

Figure 3:
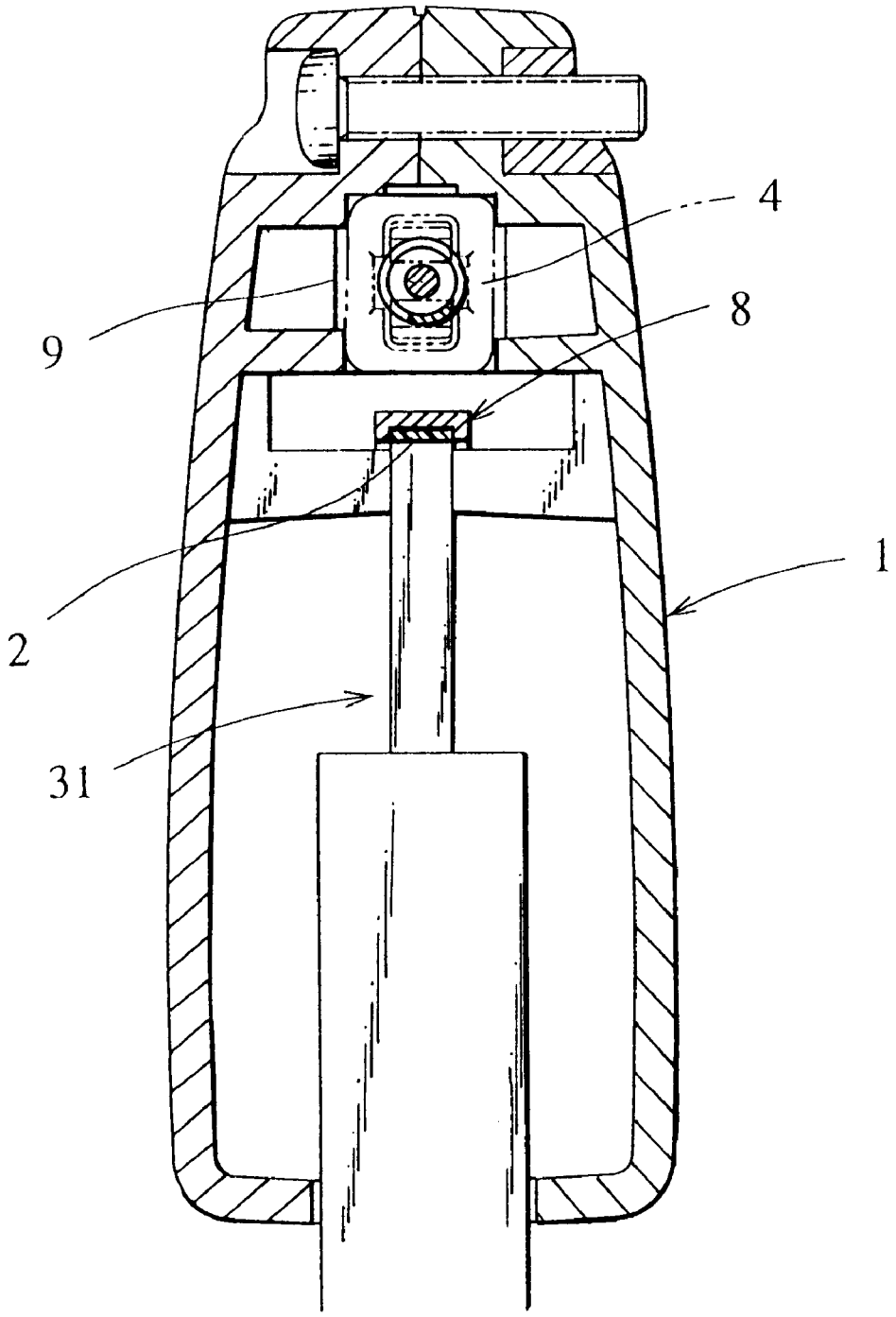
FIG. 3 is a sectional view taken along line 3—3 of FIG. 2.
Figure 4:
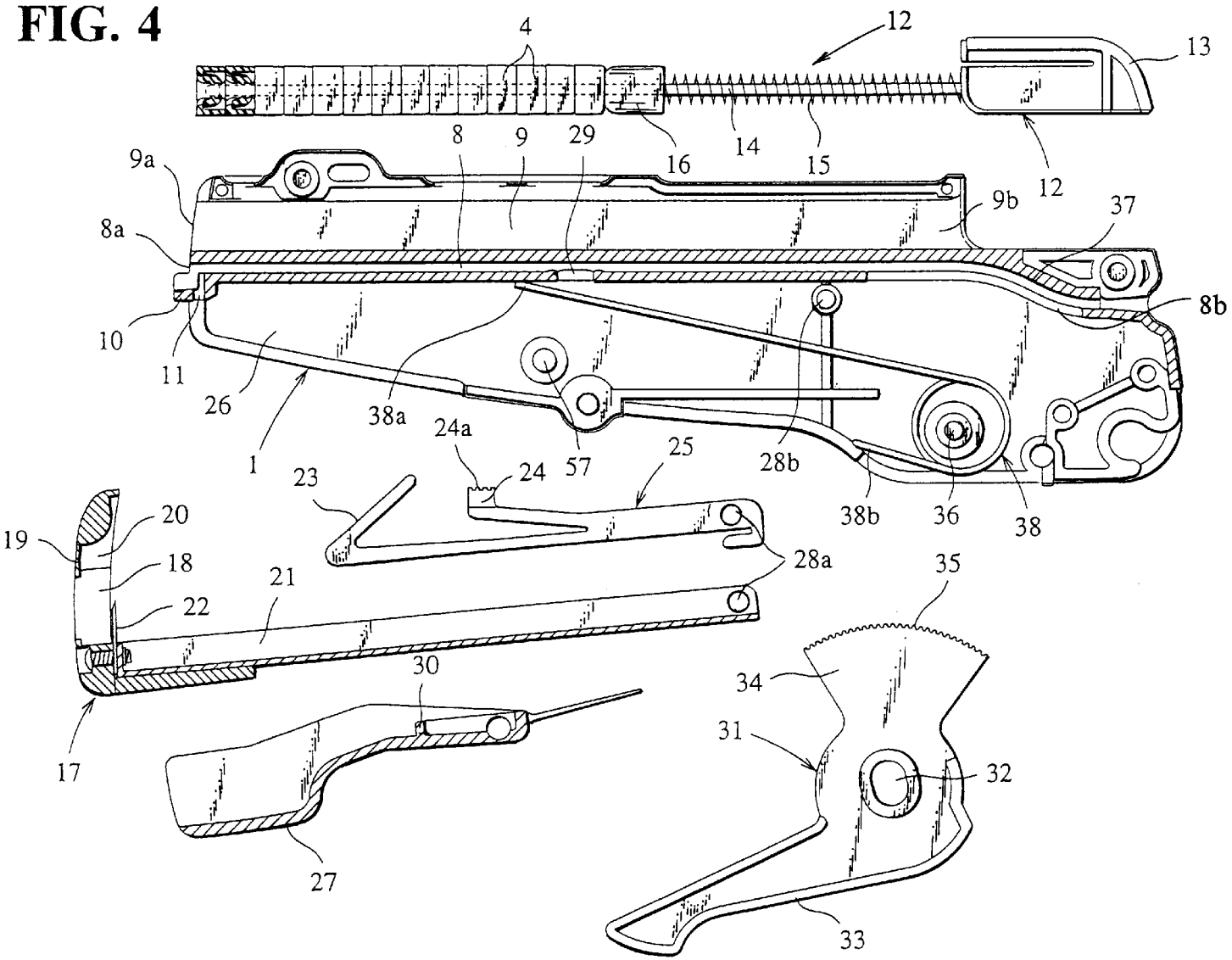
FIG. 4 is an exploded side elevation view of the binding apparatus shown in FIG. 1.

The body 1 of the binding apparatus A, as shown in FIGS. 2 to 4, is provided therein with a belt passage 8 for permitting the binding belt 2 fed from the binding belt casing 3 to be guided from a rear end of the body 1 to a front end thereof therethrough and a fastener passage 9 for guiding a plurality of the fasteners 4 each adapted to fasten an end of the binding belt 2 therethrough while keeping the fasteners 4 arranged in a row. The belt passage 8 and fastener passage 9 are arranged so as to be substantially parallel to each other. Also, the belt passage 8 and fastener passage 9 have front openings 8*a* and 9*a* formed on front ends thereof so as to be substantially vertically flush with each other, respectively. The belt passage 8 has a receiving element 10 for the fastener 4 formed at a lower portion of the front opening 8*a* thereof. The receiving element 10 is formed on a base portion thereof with a cutter insertion opening or groove 11.

The fastener passage 9 has a fastener extrusion or push-out means 12 arranged therein in a manner to be detachable therefrom. The fastener push-out means 12 includes a lug 13, a rod-like push guide 14 connected to the lug 13 so as to outwardly extend therefrom, a spring 15 and a push block 16. The spring 15 and push block 16 are each mounted on the push guide 14 so as to be slidable thereon. The spring 15 is arranged between the push block 16 and the lug 13. The lug 13 includes a holding means (not shown) detachably held on the body 1. In the fastener push-out means 12 thus configured, the push guide 14 is inserted through a rear opening 9*b* of the fastener passage 9 into the fastener passage 9 to abut the push block 16 against a rearmost fastener 4 of the plurality of fasteners 4 to forwardly force the fasteners 4 by elastic force of the spring 15.

Also, the body 1 of the binding apparatus A, as shown in FIGS. 2 and 4, is provided with an actuation head 17 so as to be vertically actuated along a front surface of the body 1. The actuation head 17 is formed with an opening 18 so as to extend back and forth therethrough. In addition, the actuation head 17 is formed with a front wall 19 so as to be positioned above a front portion of the opening 18. Also, the actuation head 17 has a fastener holder 20 arranged on a lower portion of a rear surface of the front wall 19. The actuation head 17 thus constructed is mounted on a front end of an actuation arm 21 which is formed to have a U-shape in section.

In addition to the actuation head 17, the actuation arm 21 has a cutter 22 fixedly arranged on the front end thereof in a manner to be positioned immediately behind the actuation head 17. On the actuation arm 21 is arranged a member 25 which is made of a synthetic resin material and has a return spring 23 and a stopper 24 formed integrally therewith. The synthetic resin member 25 and actuation arm 21 are received in a space 26 defined below the belt passage 8 in the body 1. The synthetic resin member 25 and actuation arm 21 are each formed at a rear end thereof with a bearing hole 28*a*, which is engagedly fitted on a common support shaft 28*b* securely mounted between side walls of the body 1 defining the above-described space 26 therebetween so that the synthetic resin member 25 and actuation arm 21 may each be pivotally moved about the support shaft 28*b*.

The actuation head 17 constructed as described above is arranged so as to be movable between a first position at which the fastener holder 20 is aligned with the front opening 9*a* of the fastener passage 9 and a second position at which the fastener holder 20 is aligned with the front opening 8*a* of the belt passage 8. The cutter 22 is configured so as to be moved along the front opening 8*a* of the belt passage 8 through the cutter insertion groove 11 of the receiving element 10 projectedly formed on the front end of the body 1 in association with the actuation head 17 when the actuation head 17 is moved from the second position to the first position. The stopper 24 is provided at a distal end thereof with a rugged portion 24*a* adapted to be engaged with the asperities 5 of the binding belt 2. Also, the stopper 24 is arranged below the belt passage 8 so as to retractably advance into the belt passage 8 through an opening 29 formed through a wall arranged between the belt passage 8 and the space 26.

The binding apparatus A of the illustrated embodiment also includes an operation lever 27 arranged at a lower portion of the body 1 and pivotally supported on a shaft 57 mounted on the body 1. The operation lever 27 is provided on a proximal portion thereof with an upwardly extending projection 30. The operation lever 27 is so arranged that the projection 30 is abutted at an upper end thereof against a lower surface of the actuation arm 21.

The binding belt casing 3 is provided therein with a binding belt receiving section of a circular shape. Also, the binding belt casing 3 is formed with a drawing opening through which the binding belt 2 is drawn out of the casing 3. The binding belt casing 3 is detachably mounted on the body 1.

The binding apparatus A of the illustrated embodiment further includes a tightening mechanism constituted by a tightening lever 31 pivotally mounted on a lower portion of a rear region of the body 1. The tightening lever 31 is formed at a substantially intermediate portion thereof with an elongated hole 32 in a manner to vertically extend. Also, the tightening lever 31 is integrally provided at a lower portion thereof with a lever section 33 and at an upper portion thereof with a fan-shaped section 34. The fan-shaped section 34 is provided at a distal end thereof with a gear portion 35. The gear portion 35 includes a plurality of teeth arranged on the distal end in an arcuate manner. The belt passage 8 is formed at a portion of a lower side thereof positionally corresponding to the gear portion 35 with an opening 8*b*. The opening 8*b* permits the asperities 5 of the binding belt 2 to be exposed therethrough, so that the asperities 5 may be engaged with the gear portion 35 through the opening 8*b*. The lever section 33 is arranged so as to extend outwardly of the body 1. Also, the elongated hole 32 of the tightening lever 31 is fitted therein with a support shaft 36 securely arranged between both side walls of the body 1, so that the tightening lever 31 may be vertically moved so as to access the belt passage 8 and to be away from the belt passage 8 and pivotally moved about the support shaft 36.

The above-described opening 8*b* of the belt passage 8 is formed so as to arcuately extend in correspondence to the gear portion 35 of the tightening lever 31. Also, the body 1 is provided therein with a guide 37 (FIG. 4) which functions to guide the binding belt 2 while arcuately bending it. Alternatively, the illustrated embodiment may be so configured that the side plates of the body 1 are each formed with an elongated hole and the tightening lever 31 is mounted thereon with a shaft pivotally fitted in the elongated hole.

The support shaft 36 has a torsion coil spring 38 wound therearound. The torsion coil spring 38 is engaged at one end 38*a* thereof with a lower surface of the belt passage 8 of the body 1 and at the other end 38*b* thereof with the tightening lever 31. Such arrangement of the torsion coil spring 38 permits elastic force of the spring 38 to constantly downwardly urge the tightening lever 31, resulting in the tightening lever 31 being downwardly spaced from the belt passage 8. The torsion coil spring 38 is so arranged that the one end 38*a* is engaged with the belt passage 8 at a position defined in proximity to the actuation head 17 as compared with a distal end of the lever section 33 of the tightening lever 31. This is for the reason that the position at which the one end 38*a* is engaged with the belt passage 8 acts as a fulcrum, the central loop acts as a point of load and the lever section 33 acts as a point of effort; therefore, it is undesirable that engagement of the one end 38*a* with the belt passage 8 which is positioned rearward of the lever section 33 causes the point of load to be lowered, leading to lowering of the tightening lever 31, resulting in the gear portion 35 being separated from the asperities 5 of the binding belt 2.

Now, a manner of binding of an article or articles such as electric wires or the like by the binding apparatus of the illustrated embodiment will be described.

Figure 6A:
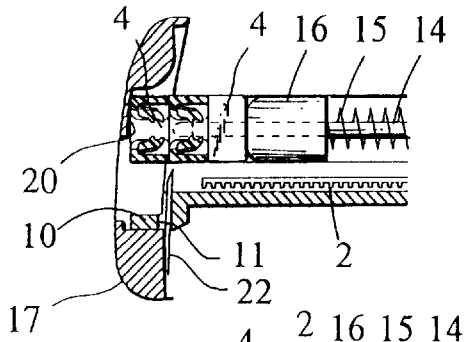
FIGS. 6A to 6E each are a fragmentary sectional view showing operation of an operation head incorporated in the binding apparatus shown in FIG. 1.
Figure 6B:
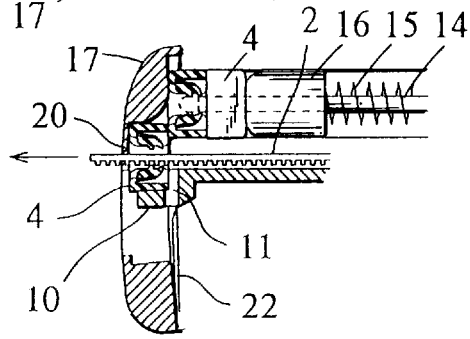

First, the operation lever 27 is drawn up while being grasped together with the body 1 of the apparatus by a hand, to thereby pivotally move the actuation arm 21 against elastic force of the return spring 23. This causes the actuation head 17 to be moved to the first position (FIG. 6A), resulting in the fastener holder 20 of the actuation head 17 being positionally aligned with the front opening 9*a* of the fastener passage 9, so that a foremost fastener of the fasteners 4 may be forced by the fastener push-out means 12, to thereby enter the fastener holder 20 and be held therein. When the operation lever 27 is released, the return spring 23 causes the actuation arm 21 to be downwardly moved, so that the actuation head 17 is moved to the second position aligned with the front opening 8*a* of the belt passage 8. This results in the fastener 4 being abuttedly received by the receiving element 10, so that the fastener 4 may be held at the above-described aligned position (FIG. 6B). Then, the binding belt 2 is drawn out of the binding belt casing 3 and inserted into the belt passage 8 of the body 1, resulting in it being guided to a central region between the holding pawls 7 of the fastener 4. Subsequently, the binding belt 2 is fed through the binding belt insertion hole 6 of the fastener 4 and then delivered forwardly of the actuation head 17.

Figure 6C:
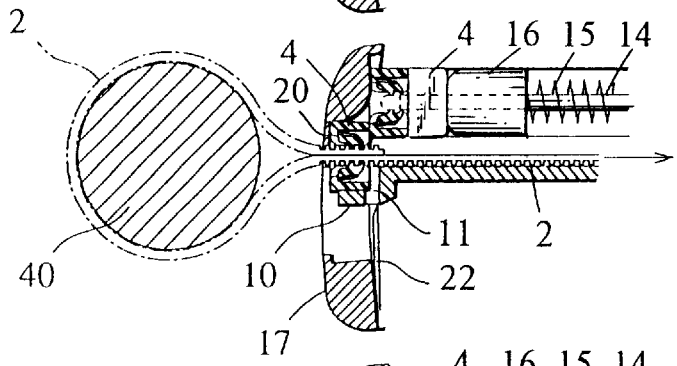

Then, the binding belt 2 is forwardly pulled and wound around an article 40 to be bound and then inserted at a distal end thereof through the insertion hole 6 of the fastener 4 in the fastener holder 20 of the actuation head 17 into the fastener 4 again, resulting in the asperities 5 of the binding belt 2 being held on the holding pawls 7 (FIG. 6C). Thereafter, when force is released from the binding belt 2 after the binding belt 2 is rearwardly drawn, the asperities 5 of the binding belt 2 and the holding pawls 7 of the fastener 4 are engaged with each other, resulting in the binding belt 2 being kept tightened to a certain degree.

Figure 7A:
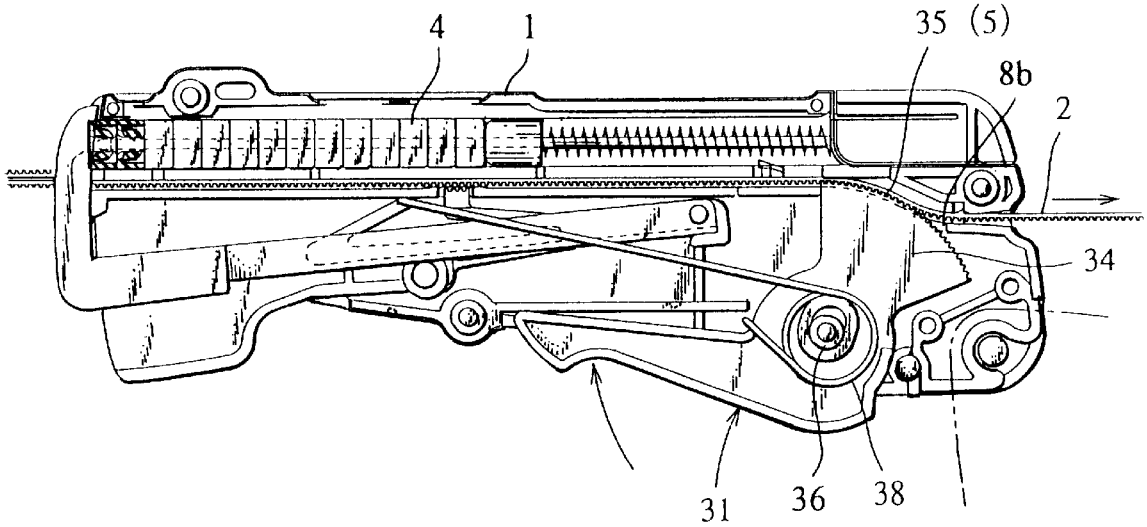
FIGS. 7A and 7B each are a sectional view showing operation of a tightening lever incorporated in the binding apparatus shown in FIG. 1.

Subsequently, when the tightening lever 31 is upwardly pivotally moved as shown in FIG. 7A, the whole tightening lever 31 is upwardly moved with respect to the support shaft 36 against the torsion coil spring 38, to thereby engage the gear portion 35 of the fan-shaped section 34 with the asperities 5 of the binding belt 2. Also, the tightening lever 31 is further pivotally moved in a clockwise direction in FIG. 7A, so that the binding belt 2 is rearwardly pulled back, to thereby be further tightened. The gear portion 35 is formed to have an arcuate configuration, so that engagement between the gear portion 35 and the asperities 5 is stably ensured throughout pivotal movement of the tightening lever 31, to thereby effectively prevent damage to the gear portion 35 and asperities 5. Further, the tightening lever 31 utilizes a lever action, resulting in positive tightening of the binding belt 2 being ensured.

Figure 7B:
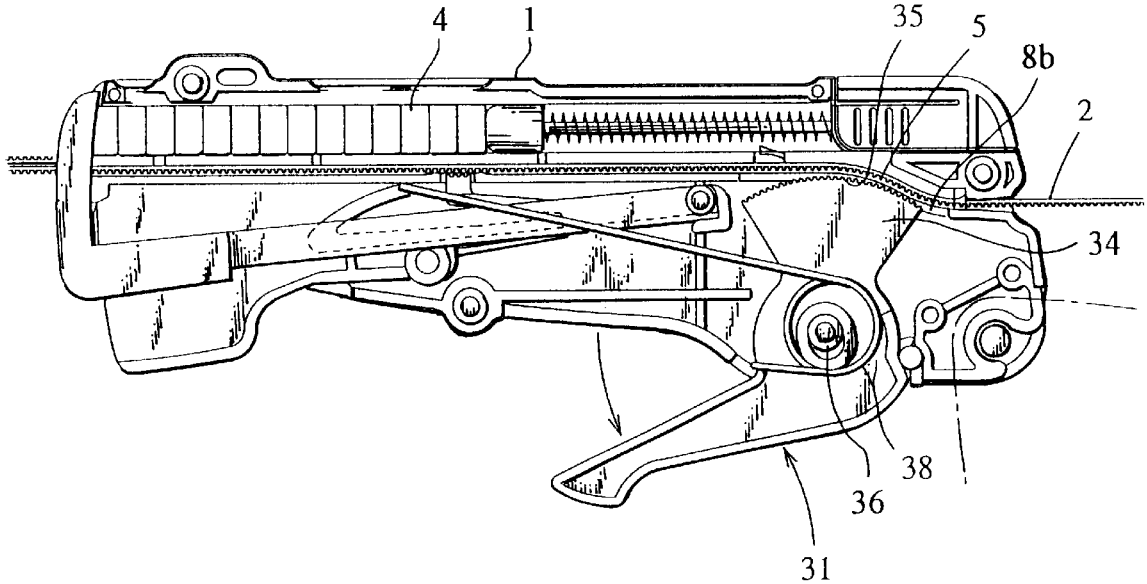

When the tightening lever 31 is released after it is pivotally moved as described above, it is downwardly moved by elastic force of the torsion coil spring 38 as shown in FIG. 7B, so that the gear portion 35 of the fan-shaped section 34 is released from engagement with the asperities 5 of the binding belt 2. This permits the tightening lever 31 to be returned to the initial position while being pivotally moved in a counterclockwise direction. When the tightening lever 31 is drawn again, the binding belt 2 is further tightened in such a manner as described above. Such pivotal movement of the tightening lever 31 is repeated several times, resulting in the binding belt 2 being firmly tightened, so that the article 40 may be securely bound.

Figure 6D:
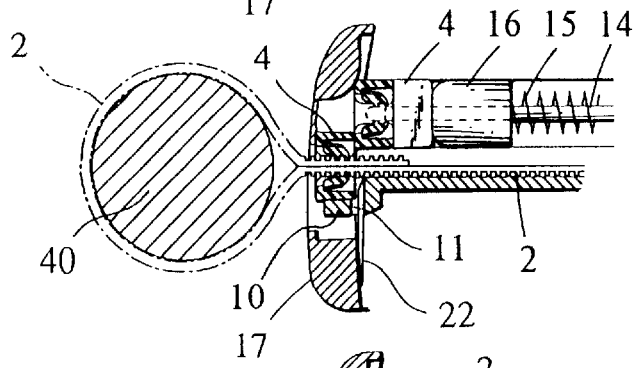
Figure 6E:
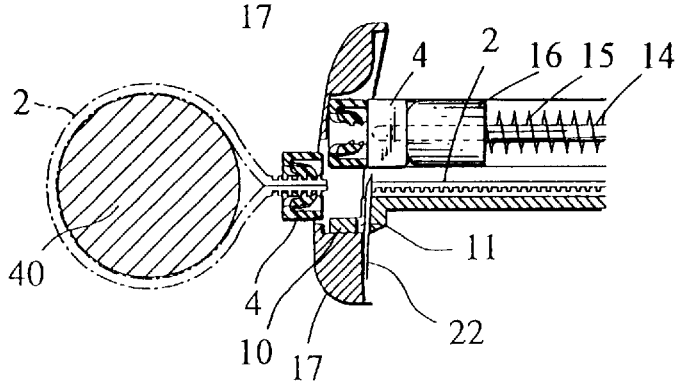

When the operation lever 27 is upwardly pivotally moved to move the actuation head 17 to the first position after the tightening operation, the cutter 22 is operated in association with such movement of the actuation head 17, to thereby be transferred through the cutter insertion groove 11 of the receiving element 10. This permits the cutter 22 to cut the binding belt 2, so that a portion of the binding belt 2 wound around the article 40 may be separated from the binding belt 2 as shown in FIGS. 6D and 6E. This results in the binding operation being completed. Concurrently, the next fastener 4 is fed into the actuation head 17; so that when the actuation head 17 is returned to the second position, the fastener 4 is lowered onto the receiving element 10. This permits the binding apparatus A to be ready for the next binding operation.

Figure 8:
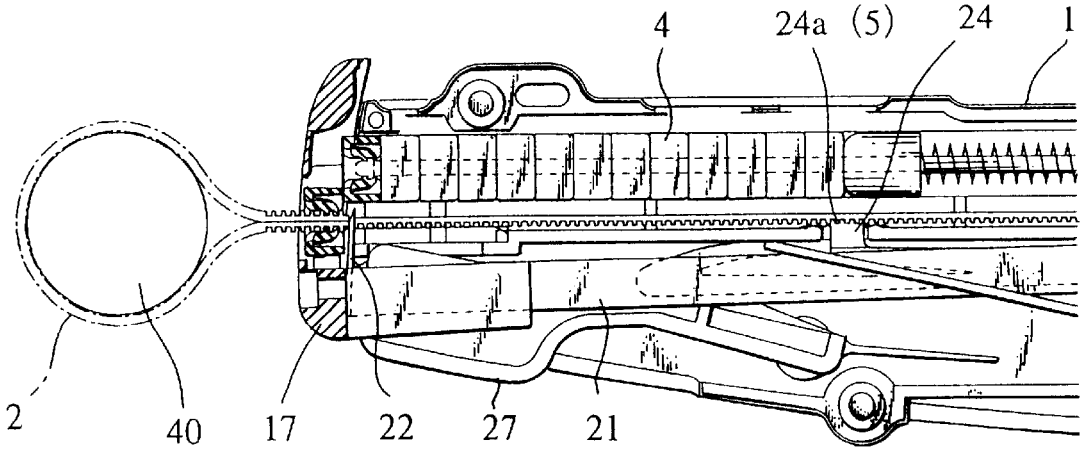
FIG. 8 is a fragmentary sectional view showing a braking operation of a stopper incorporated in the binding apparatus shown in FIG. 1.

When the actuation head 17 is moved from the second position to the first position by a hand which grasps the body 1 during operation of tightening the binding belt 2, the rugged portion 24*a* of the stopper 24 provided on the actuation arm 21 is engaged with the asperities 5 of the binding belt 2 as shown in FIG. 8, so that transfer or feed of the binding belt 2 is forcibly stopped. This effectively eliminates a disadvantage such as making a nick in a blade of the cutter 22 due to forcible pulling of the binding belt 2 carried out without noticing contact of the cutter 22 with the binding belt 2.

Figure 9:
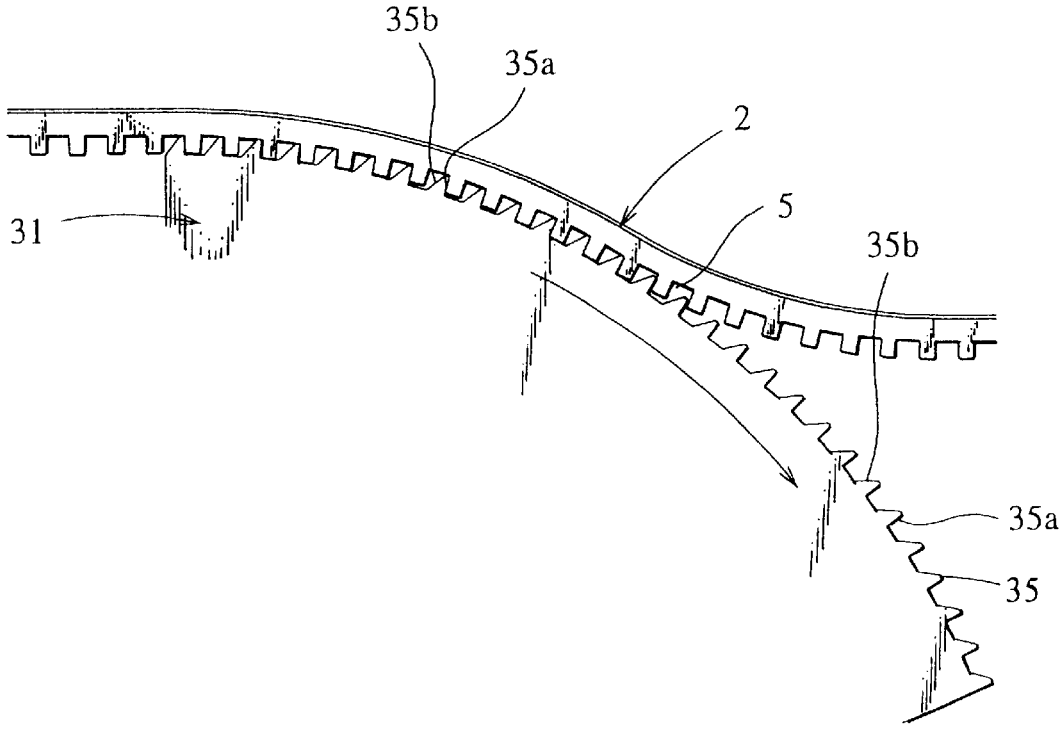
FIG. 9 is an enlarged side elevation view showing a configuration of a gear portion of a tightening mechanism incorporated in the binding apparatus shown in FIG. 1.

In the illustrated embodiment, the gear portion 35, as shown in FIG. 9, is preferably configured so that a surface 35*a* of each of teeth of the gear portion 35 engaged with the asperities 5 of the binding belt 2 extends in a radial direction of the gear portion 35 and a surface 35*b* thereof opposite to the surface 35*a* is inclined. Such configuration of the gear portion 35 facilitates release of the gear portion 35 from engagement with the asperities 5 of the binding belt 2 after the tightening.

The tightening mechanism described above permits tightening of the binding belt 2 to be readily and positively attained without directly touching the binding belt 2 while being simplified in structure.

Figure 10A:
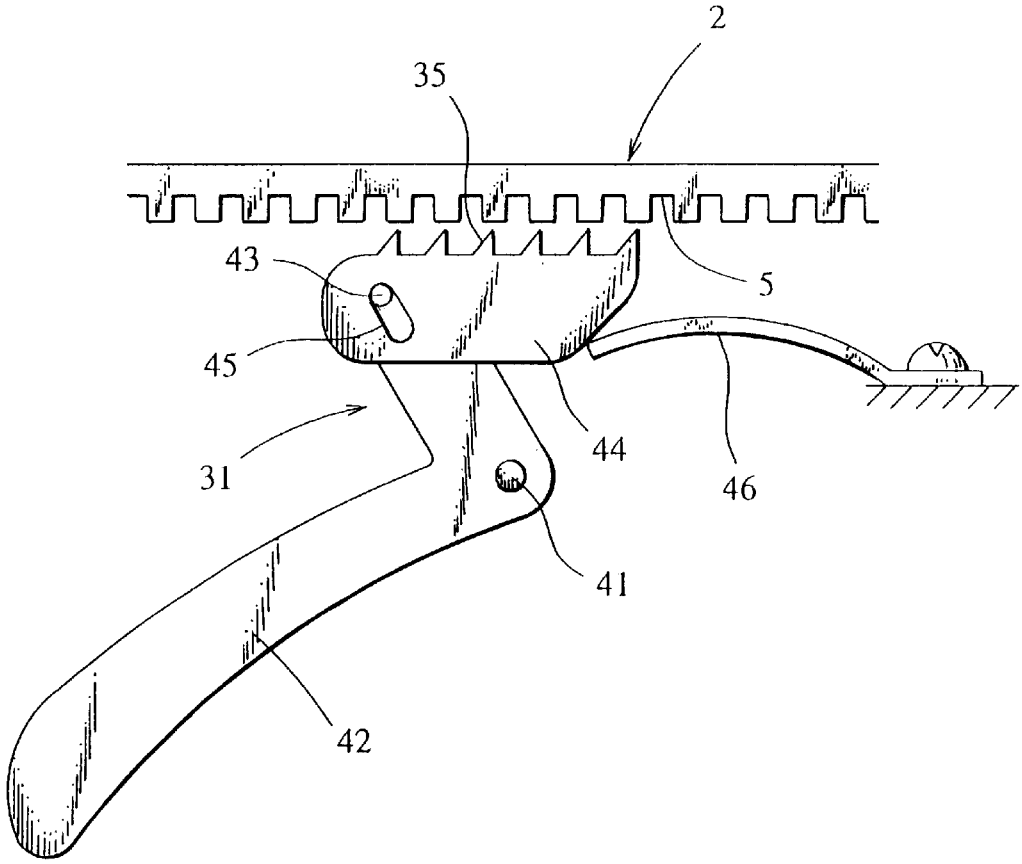
FIGS. 10A and 10B each are a schematic view showing a modification of a tightening mechanism incorporated in the binding apparatus shown in FIG. 1.
Figure 10B:
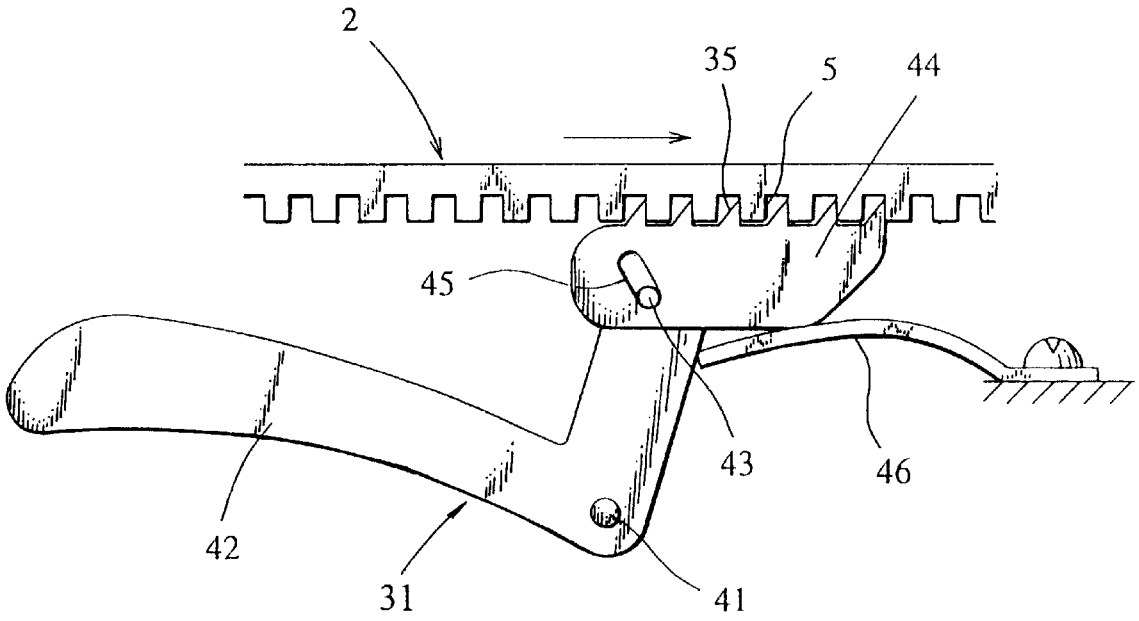

Referring now to FIGS. 10A and 10B, a modification of the tightening mechanism is illustrated. In the modification, a tightening lever 31 includes a lever section 42 pivotally mounted on a support shaft 41 of the body 1 of the binding apparatus and an actuation block 44 pivotally connected to a distal end of the lever section 42 through a shaft 43. The actuation block 44 is formed on an upper surface thereof with a gear portion 35. The shaft 43 of the actuation block 44 is formed with an elongated bearing hole 45 in a manner to obliquely extend. The actuation block 44 is so constructed that a rear end thereof is moved along an elastic guide plate 46 arranged in the body 1. The lever section 42 is elastically urged so as to be constantly kept at a lowered position as shown in FIG. 10A.

In the modification of FIGS. 10A and 10B thus constructed, tightening of the binding belt 2 is carried out by vertically pivotally operating the tightening lever 31 while grasping it together with the body 1 by a hand. This permits the actuation block 44 to be rearwardly moved as shown in FIG. 10B during upward pivotal movement of the tightening lever 31. In this instance, the rear end of the actuation block 44 is moved along the elastic guide plate 46 and a front end thereof is moved due to movement of the shaft 43 in the bearing hole 45, so that the gear portion 35 may be upwardly moved, to thereby be engaged with the asperities 5 of the binding belt 2 and rearwardly move the binding belt 2, to thereby tighten the binding belt 2. During downward pivotal movement of the tightening lever 31, the above-described operation leads to forward movement of the actuation block 44 from a position shown in FIG. 10B to that shown in FIG. 10A, to thereby release the gear portion 35 from engagement with the asperities 5. Such operation is repeated to complete tightening of the binding belt 2.

Figure 11A:
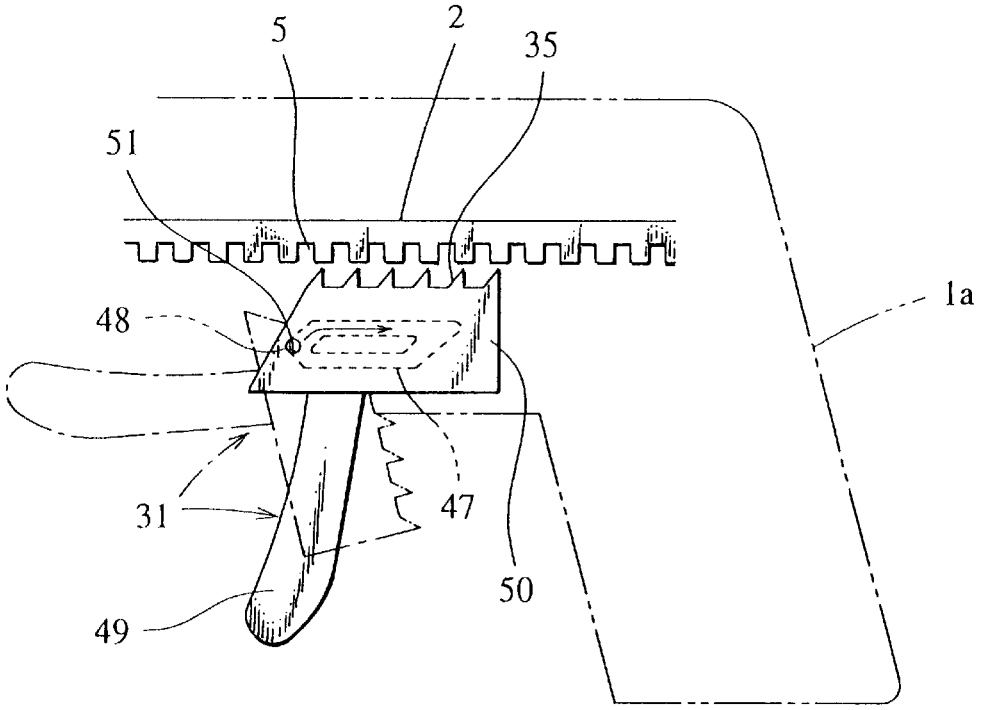
FIGS. 11A and 11B each are a schematic view showing another modification of a tightening mechanism incorporated in the binding apparatus shown in FIG. 1.
Figure 11B:
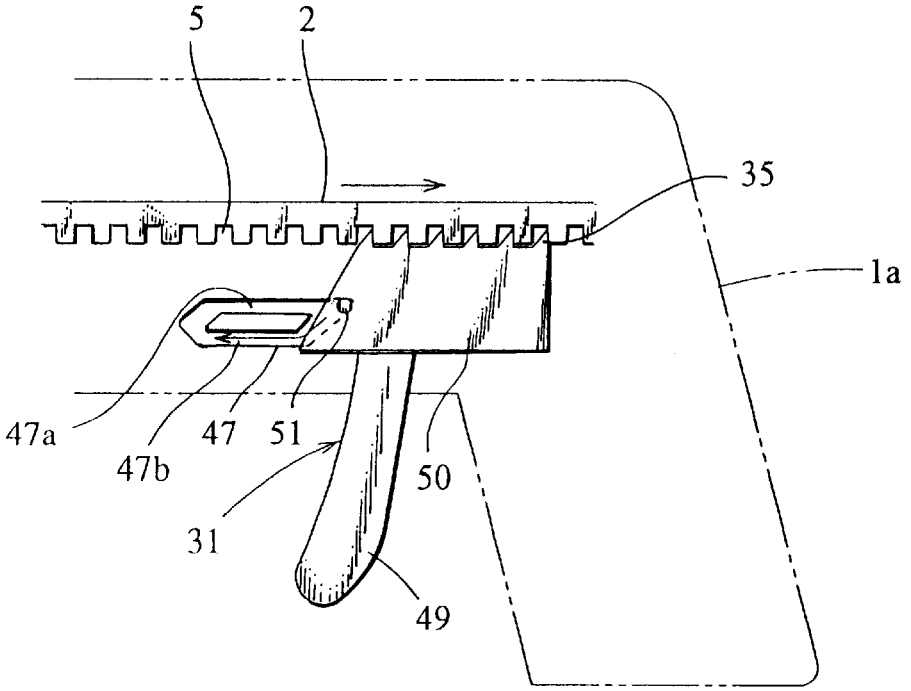

Alternatively, the tightening mechanism may be modified in such a manner as shown in FIGS. 11A and 11B. The modification is constructed so as to reciprocate a tightening lever 31 substantially in parallel to the belt passage 8. For this purpose, the body 1 of the binding apparatus is provided on a rear portion thereof with a grip la and formed therein with guide grooves 47 in parallel to the belt passage 8. Each of the guide grooves 47 is constituted by an upper groove section 47*a* and a lower groove section 47*b* which are circulatedly contiguous to each other, so that the guide groove 47 is formed to have a parallelogram-like shape. Also, the guide groove 47 has a front angular end 48 somewhat upwardly positioned. The tightening lever 31 is constituted by a lever section 49 and a block 50 including a gear portion 35. The tightening lever 31 is provided on each of both sides thereof with a shaft 51, which is engagedly fitted in the guide groove 47, so that the tightening lever 31 may be not only pivotally moved but moved back and forth along the upper and lower groove sections 47*a* and 47*b*. The tightening lever 31 is maintained at a state indicated by dashed lines in FIG. 11A during non-use thereof. The tightening lever 31 is constantly forwardly urged by a spring (not shown).

In the modification of FIGS. 11A and 11B, tightening of the binding belt 2 is carried out by rearwardly moving the tightening lever 31. This permits the shafts 51 to be guided from a position shown in FIG. 11A to the upper groove sections 47*a* of the guide grooves 47, to thereby engage the gear portion 35 with the asperities 5 of the binding belt 2, leading to rearward movement of the binding belt 2 as shown in FIG. 11B, to thereby ensure tightening of the binding belt 2. On the contrary, when the tightening lever 31 is released from force applied thereto, it is forwardly moved. During forward movement of the tightening lever 31, the shafts 51 are permitted to pass through the lower groove sections 47*b*, to thereby keep the gear portion 35 from being abutted against the asperities 5 of the binding belt 2. The shafts 51 are permitted to be stopped at a position somewhat above the front angular ends 48 of the guide grooves 47. Such operation is repeated to complete tightening of the binding belt 2.

Figure 12A:
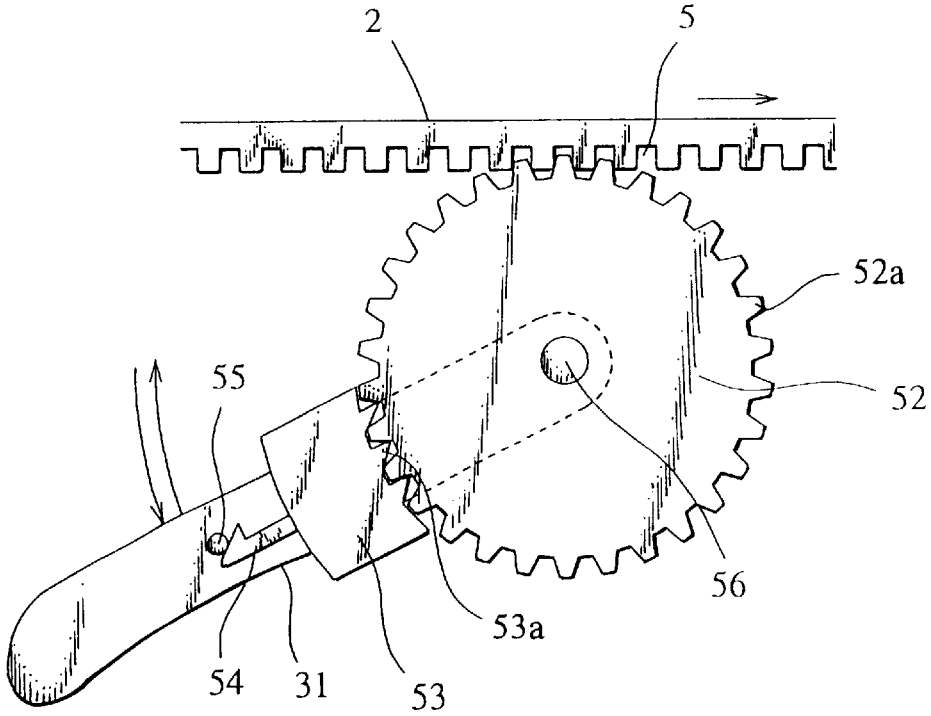
FIGS. 12A and 12B each are a schematic view showing a further modification of a tightening mechanism incorporated in the binding apparatus shown in FIG. 1.
Figure 12B:
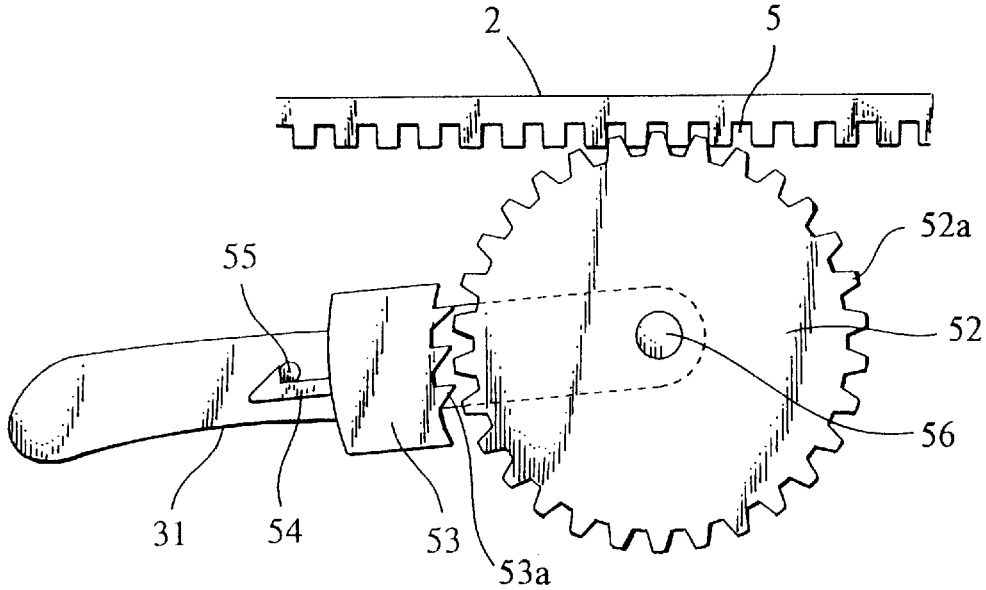

Referring now to FIGS. 12A and 12B, a further modification of the tightening mechanism is illustrated. The modification is configured in such a manner that a circular tightening gear 52 is rotatably supported on the body 1 of the apparatus and has a gear portion 52*a* thereof kept constantly engaged with the asperities 5 of the binding belt 2. A tightening lever 31 is mounted on a revolving shaft 56 of the tightening gear 52. Operation of tightening the binding belt 2 is carried out by rotating the tightening gear 52 through the tightening lever 31. The tightening lever 31 is mounted thereon with an actuation block 53 in a manner to be slidable in a longitudinal direction thereof. A gear portion 53*a* is formed on the actuation block 53. The actuation block 53 is elastically urged toward the tightening gear 52 by a spring (not shown) and formed with a holding element 54 engageable with a projection 55 provided on the tightening lever 31.

In the modification of FIGS. 12A and 12B, tightening of the binding belt 2 is carried out by vertically pivotally moving the tightening lever 31. During upward movement of the tightening lever 31, the actuation block 53 is engaged with the tightening gear 52 to pivotally move the tightening gear 52 in a clockwise direction in FIG. 12A, leading to tightening of the binding belt 2. During downward movement of the tightening lever 31, the actuation block 53 is backwardly pushed, to thereby be released from engagement with the tightening gear 52. When the binding belt 2 is not tightened, the holding element 54 of the actuation block 53 is engaged with the projection 55 of the tightening lever 31 against elastic force of the spring, to thereby permit free rotation of the tightening gear 52.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A binding apparatus comprising:

a body provided therein with a belt passage and a fastener passage, said belt passage guiding therethrough a continuous binding belt formed on one side surface thereof with asperities in a rack-like manner, said fastener passage guiding a plurality of fasteners therethrough while keeping the fasteners arranged in a row, the fasteners each being provided with holding pawls engageable with the asperities of the binding belt;

a cutter for cutting the binding belt in a state where a foremost fastener of the fasteners located at a distal end of said fastener passage is fed to a distal end of said belt passage and the binding belt is held by the foremost fastener on one of the holding pawls at a distal end of a portion of the binding belt, which portion is wound around an article while being extended through the foremost fastener, to bind the article with the portion of the binding belt;

said belt passage being formed with an opening through which the binding belt is exposed; and a tightening mechanism movably mounted on said body, said tightening mechanism including a gear portion constructed so as to be releasably connected with the asperities of the binding belt exposed from said opening of said belt passage.

2. A binding apparatus as defined in claim 1, wherein said tightening mechanism includes a tightening lever which is formed thereon with said gear portion so as to be engageable with the asperities of the binding belt and pivotably arranged.

3. A binding apparatus as defined in claim 2, wherein said tightening lever is arranged so as to access said belt passage and to be moved away from said belt passage.

4. A binding apparatus as defined in claim 3, wherein said gear portion of said tightening lever comprises a plurality of teeth arranged on a distal end of said tightening lever in an arcuate manner.

5. A binding apparatus as defined in claim 4, further comprising a spring for elastically urging said tightening lever so that said tightening lever is spaced from said belt passage.

6. A binding apparatus as defined in claim 3, further comprising a spring for elastically urging said tightening lever so that said tightening lever is spaced from said belt passage.

7. A binding apparatus as defined in claim 2, wherein said gear portion of said tightening lever comprises a plurality of teeth arranged on a distal end of said tightening lever in an arcuate manner.

8. A binding apparatus as defined in claim 4, further comprising a spring for elastically urging said tightening lever so that said tightening lever is spaced from said belt passage.

9. A binding apparatus as defined in claim 2, further comprising a spring for elastically urging said tightening lever so that said tightening lever is spaced from said belt passage.

10. A binding apparatus comprising:

a body provided therein with a belt passage and a fastener passage, said belt passage guiding therethrough a continuous binding belt formed on one side surface thereof with asperities in a rack-like manner, said fastener passage guiding a plurality of fasteners therethrough while keeping the fasteners arranged in a row, the fasteners each being provided with holding pawls engageable with the asperities of the binding belt;

a cutter for cutting the binding belt in a state where a foremost fastener of the fasteners located at a distal end of said fastener passage is fed to a distal end of said belt passage and the binding belt is held by the foremost fastener on one of the holding pawls at a distal end of a portion of the binding belt, which portion is wound around an article while being extended through the foremost fastener, to bind the article with the portion of the binding belt;

said belt passage being formed with an opening through which the binding belt is exposed; and a tightening mechanism movably mounted on said body, said tightening mechanism including a tightening lever with a gear portion at one end and a lever section at another end extending outwardly of said body, said gear portion constructed so as to be releasably connected with the asperities of the binding belt exposed from said opening of said belt passage, wherein said tightening lever is arranged so as to access said belt passage and to be moved away from said belt passage.

11. A binding apparatus as defined in claim 10, wherein said tightening mechanism includes a tightening lever which is formed thereon with said gear portion so as to be engageable with the asperities of the binding belt and which is arranged so as to be movable substantially in parallel to the binding belt.

12. A binding apparatus as defined in claim 10, wherein said tightening mechanism includes a tightening gear rotatably mounted on said body;

said tightening gear being engaged with the asperities of the binding belt exposed from said opening of said belt passage and rotated to tighten the binding belt in association with said gear portion.

13. A binding apparatus as defined in claim 12, wherein said tightening mechanism further includes a tightening lever which is formed thereon with said gear portion and pivotally arranged, said gear portion being constructed so as to be releasably engaged with said tightening gear.

14. A binding apparatus as defined in claim 10, wherein said tightening lever is arranged so as to access said belt passage and to be moved away from said belt passage.

15. A binding apparatus as defined in claim 14, wherein said gear portion of said tightening lever comprises a plurality of teeth arranged on a distal end of said tightening lever in an arcuate manner.

16. A binding apparatus as defined in claim 15, further comprising a spring for elastically urging said tightening lever so that said tightening lever is spaced from said belt passage.

17. A binding apparatus as defined in claim 14, further comprising a spring for elastically urging said tightening lever so that said tightening lever is spaced from said belt passage.

18. A binding apparatus as defined in claim 10, wherein said gear portion of said tightening lever comprises a plurality of teeth arranged on a distal end of said tightening lever in an arcuate manner.

19. A binding apparatus as defined in claim 18, further comprising a spring for elastically urging said tightening lever so that said tightening lever is spaced from said belt passage.

20. A binding apparatus as defined in claim 10, further comprising a spring for elastically urging said tightening lever so that said tightening lever is spaced from said belt passage.

21. A binding apparatus as defined in claim 10, wherein said tightening mechanism includes a tightening gear rotatably mounted on said body;

said tightening gear being engaged with the asperities of the binding belt exposed from said opening of said belt passage and rotated to tighten the binding belt in association with said gear portion, wherein said tightening mechanism further includes a tightening lever which is formed thereon with said gear portion and pivotally arranged, said gear portion being constructed so as to be releasably engaged with said tightening gear.

22. A binding apparatus comprising:

a body provided therein with a belt passage and a fastener passage, said belt passage guiding therethrough a continuous binding belt formed on one side surface thereof with asperities in a rack-like manner, said fastener passage guiding a plurality of fasteners therethrough while keeping the fasteners arranged in a row, the fasteners each being provided with holding pawls engageable with the asperities of the binding belt;

a cutter for cutting the binding belt in a state where a foremost fastener of the fasteners located at a distal end of said fastener passage is fed to a distal end of said belt passage and the binding belt is held by the foremost fastener on one of the holding pawls at a distal end of a portion of the binding belt, which portion is wound around an article while being extended through the foremost fastener, to bind the article with the portion of the binding belt;

said belt passage being formed with an opening through which the binding belt is exposed;

a tightening mechanism movably mounted on said body, said tightening mechanism including a gear portion constructed so as to be releasably connected with the asperities of the binding belt exposed from said opening of said belt passage;

wherein said tightening mechanism includes a tightening lever which is formed thereon with said gear portion so as to be engageable with the asperities of the binding belt and which is arranged so as to be movable substantially in parallel to the binding belt.

23. A binding apparatus comprising:

a body provided therein with a belt passage and a fastener passage, said belt passage guiding therethrough a continuous binding belt formed on one side surface thereof with asperities in a rack-like manner, said fastener passage guiding a plurality of fasteners therethrough while keeping the fasteners arranged in a row, the fasteners each being provided with holding pawls engageable with the asperities of the binding belt;

a cutter for cutting the binding belt in a state where a foremost fastener of the fasteners located at a distal end of said fastener passage is fed to a distal end of said belt passage and the binding belt is held by the foremost fastener on one of the holding pawls at a distal end of a portion of the binding belt, which portion is wound around an article while being extended through the foremost fastener, to bind the article with the portion of the binding belt;

said belt passage being formed with an opening through which the binding belt is exposed; and a tightening mechanism movably mounted on said body, said tightening mechanism including a gear portion constructed so as to be releasably connected with the asperities of the binding belt exposed from said opening of said belt passage;

wherein said tightening mechanism includes a tightening gear rotatably mounted on said body, said tightening gear being engaged with the asperities of the binding belt exposed from said opening of said belt passage and rotated to tighten the binding belt in association with said gear portion.

* * * * *

UNITED STATES PATENT AND TRADEMARK OFFICE

CERTIFICATE OF CORRECTION

PATENT NO. : 6,527,017 B2
DATED : March 4, 2003
INVENTOR(S) : Yuji Shirakawa and Shigenobu Nirei It is certified that error appears in the above-identified patent and that said Letters Patent is hereby corrected as shown below:

Column 3,
Line 25, delete ".".

Column 9,
Line 55, "4" should read -- 7 --.

Signed and Sealed this

Second Day of September, 2003

JAMES E. ROGAN
*Director of the United States Patent and Trademark Office*